US005137421A

United States Patent [19]

Hayton

[11] Patent Number: 5,137,421

[45] Date of Patent: Aug. 11, 1992

[54] SHROUD RINGS

[75] Inventor: Paul R. Hayton, Watford, England

[73] Assignee: Rolls-Royce plc, London, England

[21] Appl. No.: 577,017

[22] Filed: Sep. 4, 1990

[30] Foreign Application Priority Data

Sep. 15, 1989 [GB] United Kingdom ..... 8921003

[51] Int. Cl.[5] ..... F01D 5/20

[52] U.S. Cl. ..... 415/173.3; 415/174.2

[58] Field of Search ..... 415/115, 116, 134–139, 415/173.1, 173.3, 12, 174.2

[56] References Cited

U.S. PATENT DOCUMENTS

| | | | |
|---|---|---|---|
| 4,087,199 | 5/1978 | Hemsworth et al. | 415/173.3 |
| 4,472,108 | 9/1984 | Pask | 415/173.3 |
| 4,650,394 | 3/1987 | Weidner | 415/115 |
| 4,650,395 | 3/1987 | Weidner | 415/173.1 |
| 4,669,954 | 6/1987 | Habarou et al. | 415/173.4 |
| 4,679,981 | 7/1987 | Guibert et al. | 415/173.1 |
| 4,759,687 | 7/1988 | Miraucourt et al. | 415/209.3 |

FOREIGN PATENT DOCUMENTS

| | | |
|---|---|---|
| 0192516 | 8/1986 | European Pat. Off. . |
| 0197654 | 10/1986 | European Pat. Off. . |
| 0219721 | 4/1987 | European Pat. Off. . |
| 0243274 | 10/1987 | European Pat. Off. . |
| 1363897 | 8/1974 | United Kingdom . |

*Primary Examiner*—John T. Kwon

*Attorney, Agent, or Firm*—Oliff & Berridge

[57] ABSTRACT

A ceramic shroud ring is located within a gas turbine engine in abutment with the inner surface of the metal engine case. The ring is characterized in that it is divided by a split extending between the radially inner and outer surfaces. The natural resilience of the ring is such that it tends to open out when unconstrained, the ring thereby following the contour of the engine case as its diameter changes according to temperature. The engine case is provided with a pair of circumferential flanges directed inwardly and abutting respectively against high pressure upstream and low pressure downstream portions of the ring to define an annular cavity about the ring, and the ring is provided on its downstream face with at least one radial slot giving low pressure air access to the annular cavity. Within the thickness of the ring a slot extends from the upstream face to the downstream face and intersects the split in the ring. A seal strip occupies the slot.

3 Claims, 1 Drawing Sheet

SHROUD RINGS

FIELD OF THE INVENTION

This invention concerns improvements in or relating to shroud rings for gas turbine engines.

DESCRIPTION OF THE PRIOR ART

Shroud rings are commonly provided in gas turbine engines between the turbine case and the rotating high pressure turbine blades. The gases passing through the high pressure turbine blades are at a high temperature (850°-1700° C.) and the shroud ring fulfills the dual role of protecting the turbine case from the high gas temperatures and accommodating the thermal expansion of the blades. An annular cavity is usually provided between the shroud ring and the turbine case so as to provide an insulating barrier of cooler air.

In order to accommodate the increasingly higher temperatures being used in gas turbine engines ceramic materials are being used, especially in respect of shroud rings and blades.

The problems have arisen of keeping a ceramic shroud concentric within a metal turbine case, and of matching the thermal profiles of a ceramic shroud and a metal case. One way of solving these problems has been by suspending the ring by radial springs within the turbine case. Disadvantages of this are the expense and weight of the springs, the careful "tuning" needed to get rid of unwanted resonances in the springs, and the ever-present possibility of thermal and vibration fatigue in the springs.

BRIEF SUMMARY OF THE INVENTION

It is an object of the present invention to provide a ceramic shroud ring that overcomes the above problems.

According to the present invention there is provided a ceramic shroud ring for location within a gas turbine engine and in abutment with the inner surface of a metal engine turbine case, characterised in that the ring is divided by a split extending from the outer surface to the inner surface, the resilience of the ring being such that it tends to open out when unconstrained, whereby the ring follows the contour of the case as the diameter of the case changes in accordance with temperature changes.

Preferably, the turbine case is provided with a pair of circumferential flanges directed radially inwardly and abutting respectively against high pressure upstream and low pressure downstream portions of the ring to define an annular cavity about the ring, wherein the ring is provided on its downstream face with at least one radial slot giving low pressure air access to said annular cavity.

Preferably there is provided within the thickness of the ring a slot extending from the upstream face of the ring to the downstream face and intersecting the split, the slot being occupied by a seal strip.

The seal strip preferably extends radially outwards over the upstream face so as to cover the radially outermost portion of the split thereby to prevent high pressure air from passing into the annular cavity.

BRIEF DESCRIPTION OF THE DRAWINGS

The invention will now be described by way of example only with reference to the accompanying diagrammatic non-scale drawings in which.

DETAILED DESCRIPTION

Figure 1:
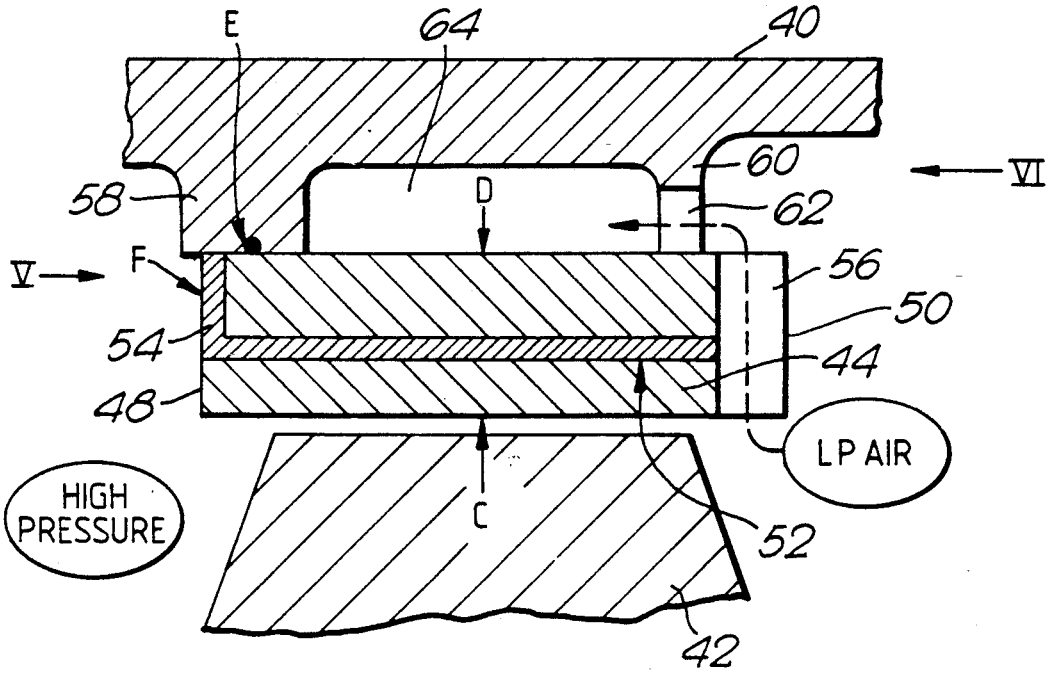
FIG. 1 is a longitudinal section through a portion of a turbine case, shroud ring, and blade, according to the invention.
Figure 2:
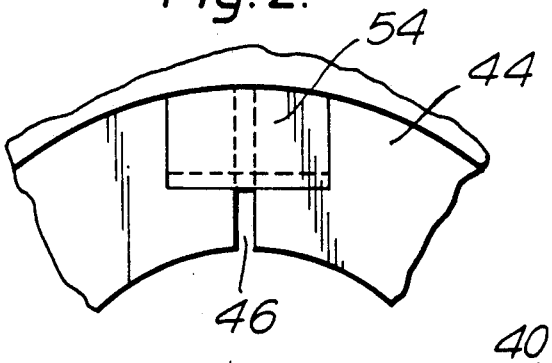
FIG. 2 is a view of the shroud ring of FIG. 1 taken in the direction of arrow V, and, FIG. 3 is a view of the shroud ring and turbine case of FIG. 1 taken in the direction of arrow VI.
Figure 3:
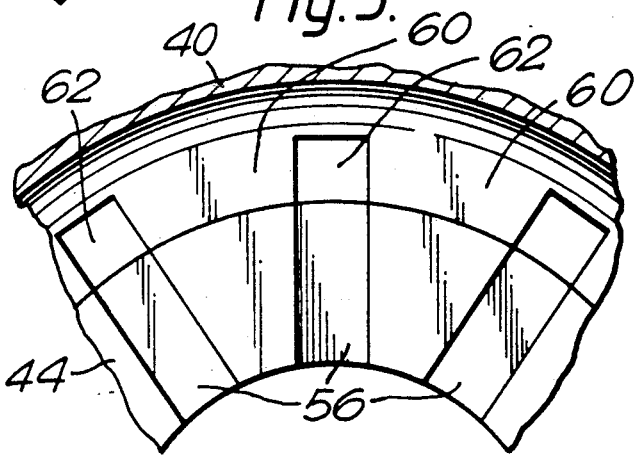

In the drawings there is shown a turbine case 40, a turbine blade 42, and a ceramic shroud ring 44. The ring 44 is provided with a radial split 46 which extends from the upstream face 48 to the downstream face 50 of the ring. Within the thickness of the ring there is provided a slot 52 extending from the upstream face 48 to the downstream face 50 and intersecting the radial split 46. The slot 52 is occupied by a seal strip 54 which, at the upstream face 48 extends radially outwards over that face so as to cover or seal the radially outermost portion of the split 46 so as to prevent the entry of high pressure gas from the upstream side of the ring.

The downstream face 50 of the ring 44 is provided with one or more radial slots 56 disposed circumferentially about the ring. The turbine case 40 is provided with inwardly extending upstream and downstream flanges 58, 60 respectively, which are in contact with the respective upstream and downstream radially outermost portions of the ring. The downstream flange 60 is provided with a series of apertures 62 which provide communication between the slots and an annular cavity 64 between the turbine case and the ring. This permits low pressure air from the downstream side of the ring to enter the cavity 64. The purpose of this arrangement is as now described.

In addition to the out-springing of the shroud ring 40 due to its natural resilience it is advisable for additional pressure to be provided between the ring and the turbine case. Upstream, high-pressure air cannot enter cavity 64 because of the sealing strip 54. However, downstream, low-pressure air can so enter by means of the slots 56. The gas pressure at C is about halfway between that of the high pressure and low pressure air. The pressure at D is that of the low pressure air. Hence there is a positive pressure difference between C and D which urges the ring against the turbine casing and improves the sealing at point E where high pressure air would otherwise tend to enter between the ring and the casing.

To ensure that there is indeed a pressure difference across the shroud between surfaces C and D, the gap at the upstream end of the shroud must be sealed at locations E and F, as is shown in the drawings by the respective abutment of flange 58 against the radially outer surface of the shroud and the presence of the sealing strip 54, although other ways of sealing could be used within the scope of the invention.

I claim:

1. A ceramic shroud ring for location within a gas turbine engine between high pressure and low pressure regions of the gas flow and in abutment with a radially inner surface of a metal engine turbine casing wherein the ring is divided by a single split extending radially from a radially outer surface of the ring to a radially inner surface of the ring and extending in a longitudinal direction of the ring between upstream and downstream faces of the ring, the material of the ring having a resilience such that when the ring is provided with said single split, the ring tends to open out when unconstrained, whereby the ring follows the contour of the radially inner surface of the engine casing as the diameter of the casing changes in accordance with temperature changes, the turbine casing having a pair of circumferential flanges directed radially inwardly and abutting respectively against high pressure upstream and low pressure downstream portions of the ring to define an annular cavity about the ring, wherein the ring is provided on its downstream face with at least one radial slot allowing low pressure air access to said annular cavity.

2. A shroud ring as claimed in claim 1 wherein there is provided within the thickness of the ring a seal slot extending from the upstream face of the ring to the downstream face and intersecting the split, the seal slot being occupied by a seal strip.

3. A shroud ring as claimed in claim 2 wherein the seal strip extends radially outwards over the upstream face of the ring so as to cover a radially outermost segment of the split in the upstream face thereby preventing high pressure air from passing into the annular cavity.

* * * * *